US005349998A

United States Patent [19]

Gonfiantini

[11] Patent Number: 5,349,998

[45] Date of Patent: Sep. 27, 1994

[54] INJECTOR MANIFOLD VALVE CAPABLE OF PREVENTING LEAKS INTO THE ENVIRONMENT, FOR COOLANT GASES

[75] Inventor: Giovanni Gonfiantini, Pistoia, Italy

[73] Assignee: Galileo Vacuum Tec S.p.A., Florence, Italy

[21] Appl. No.: 975,458

[22] Filed: Nov. 12, 1992

[30] Foreign Application Priority Data

Nov. 15, 1991 [IT] Italy ..... FI91A 273

[51] Int. Cl.[5] ..... B65B 3/00

[52] U.S. Cl. ..... 141/351; 62/292; 251/129.21; 137/597; 137/614.04; 137/614.19; 137/522; 141/DIG. 1; 141/362; 141/65

[58] Field of Search ..... 62/292, 149, 77; 137/597, 614.04, 614.19, 522; 251/129.21; 141/65, 346, 351, 360, 362, DIG. 1

[56] References Cited

U.S. PATENT DOCUMENTS 4,805,417 2/1989 Weaver et al. .
4,869,300 9/1989 Gudenau et al. .
5,080,132 1/1992 Manz et al. ..... 62/292
5,172,562 12/1992 Manz et al. ..... 62/292

*Primary Examiner*—John M. Sollecito
*Attorney, Agent, or Firm*—McGlew & Tuttle

[57] ABSTRACT

An electromagnetic control ( 12, 14, 14A) causes the opening of a valve (1A) blocking the connector (1) of the system (3) to be used; pipes (30, 34, 42) with corresponding connections to a transfer passage (20, 16, 14B, 9, 7A) are controlled by corresponding valves (36, 38, 44); one of the pipes supplies the refrigerant or other pollutant fluid, a second pipe connects the injector to a vacuum source, and a third pipe connects the injector to a suction recovery means, permitting the discharge, recovery or extraction of pollutant gas from the dead space inside the injector and if necessary from the confined volume of said system (3).

8 Claims, 5 Drawing Sheets

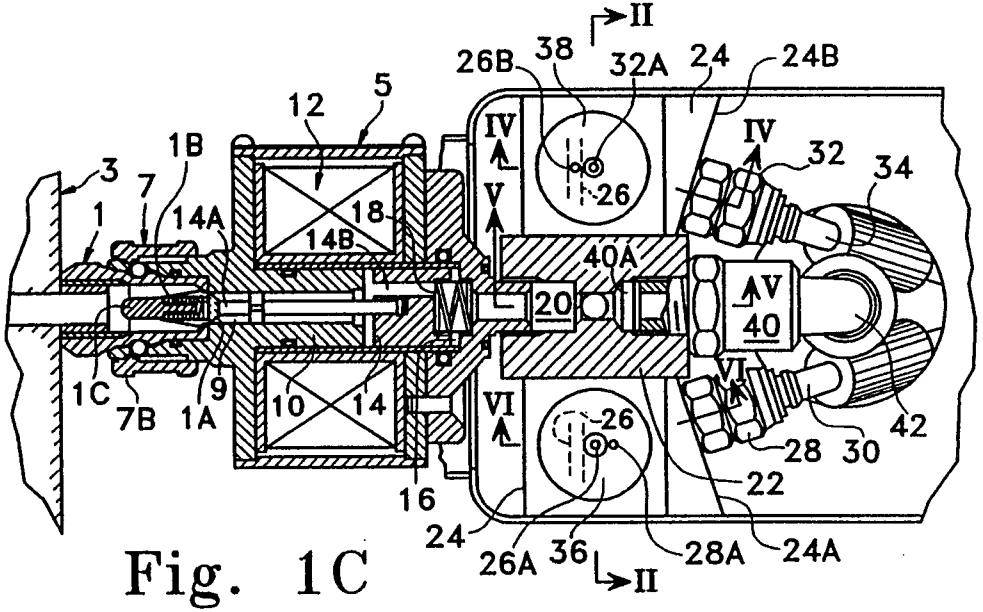
Fig. 1C
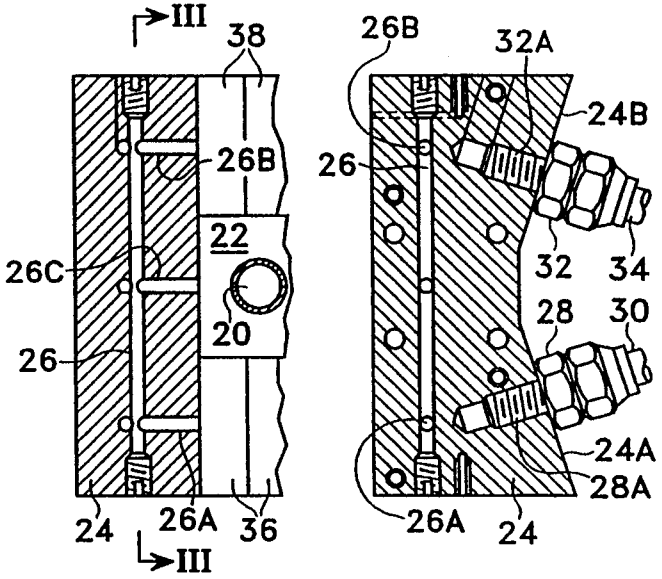
Fig. 2C
Fig. 3C
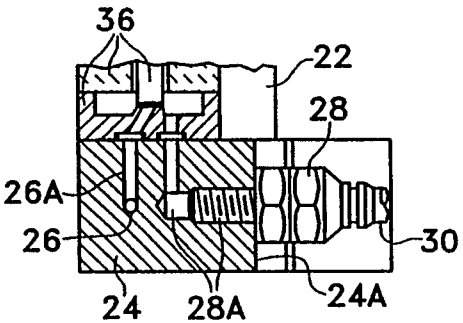
Fig. 6C
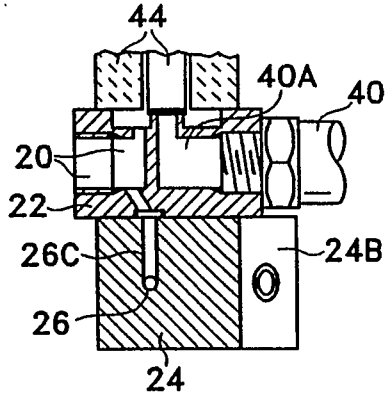
Fig. 5C
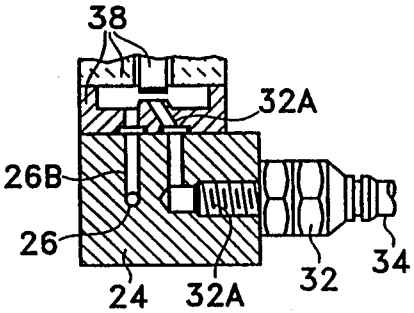
Fig. 4C

INJECTOR MANIFOLD VALVE CAPABLE OF PREVENTING LEAKS INTO THE ENVIRONMENT, FOR COOLANT GASES

FIELD AND BACKGROUND OF THE INVENTION

The invention relates to an injector used in operations for filling the confined spaces of systems of such types as refrigeration plant, coolant units and others, and for equivalent uses. The injector in question is capable of preventing leaks of pollutant gases from the confined spaces to the external environment, for example and in particular from the dead spaces inside the injector itself, and also of extracting pollutant gases, where necessary, from coolant units which are to be repaired or destroyed. These and other objects of the invention will be clearly understood from the following text.

SUMMARY AND OBJECTS OF THE INVENTION

The injector in question basically comprises:

- a control unit for opening a valve blocking the connector communicating with the confined volume of the system to be used; said control unit being combined with the quick-release coupling between the injector and said connector;
- pipes with corresponding connections to a manifold and to a passage leading to the quick-release coupling;
- selectively controlled valves, inserted in said connections, these valves, together with the quick-release coupling, delimiting a dead space in the injector.

One of the pipes supplies the refrigerant or other pollutant fluid, a second pipe connects the injector to a vacuum source, and the third pipe connects the injector to a suction recovery means, for the discharge, recovery or extraction of pollutant gas from said dead space and if necessary from the confined volume of said system.

The said control unit may be coaxial with the terminal part of the quick-release coupling carried by the injector, and its actuator is advantageously an electromagnet. Said valves are also advantageously electromagnetically controlled. Furthermore, an alternative embodiment using fluid controls, for example with compressed air, is not excluded.

The injector may comprise an additional pipe with a corresponding controlled valve and with a corresponding connection to said passage, for a flushing fluid such as nitrogen, dry air, or the like.

A control assembly may be provided to activate the various phases of the cycle from a manual start command, or one activated by connecting the two parts of the quick-release coupling or by an authorization dependent on such connection.

BRIEF DESCRIPTION OF THE DRAWINGS

The invention will be more clearly understood by an examinating the description and the attached drawing, which shows a non-restrictive practical example of said invention. In the drawing.

FIGS. 1A to 6A are similar to FIGS. 1 to 6, but show a configuration for the production of the vacuum;

FIGS. 1B to 6B are similar to FIGS. 1 to 6, but show the configuration when injection is under way; and FIGS. 1C to 6C are again similar to FIGS. 1 to 6, but show the configuration during the phase of recovery of the coolant gas from the dead space or directly from an installation to be evacuated.

DETAILED DESCRIPTION OF THE PREFERRED EMBODIMENT

According to the illustrations in the attached drawing, 1 indicates the male part of a quick-release attachment which is provided on the system 3 to be used for filling with the coolant, in other words refrigerant, fluid or for the discharge of said fluid from a system which for example is to be repaired or destroyed. 5 indicates overall the injector with the female part 7 the quick-release attachment. The male part 1 has a valve 1A which, through a spring 1B acting on a cross-piece of the pipe of the part 1 of the quick-release attachment, closes this part 1, which may be opened only by inward axial pressure. The female part 7 of the quick-release attachment has the cavity 7A with the ball or other system for locking to the groove 1E of the part I by means of a sleeve 7B which can slide axially on the part 7. Parts 1 and 7 constitute a quick-release attachment of a type similar to conventional attachments.

Figure 1:
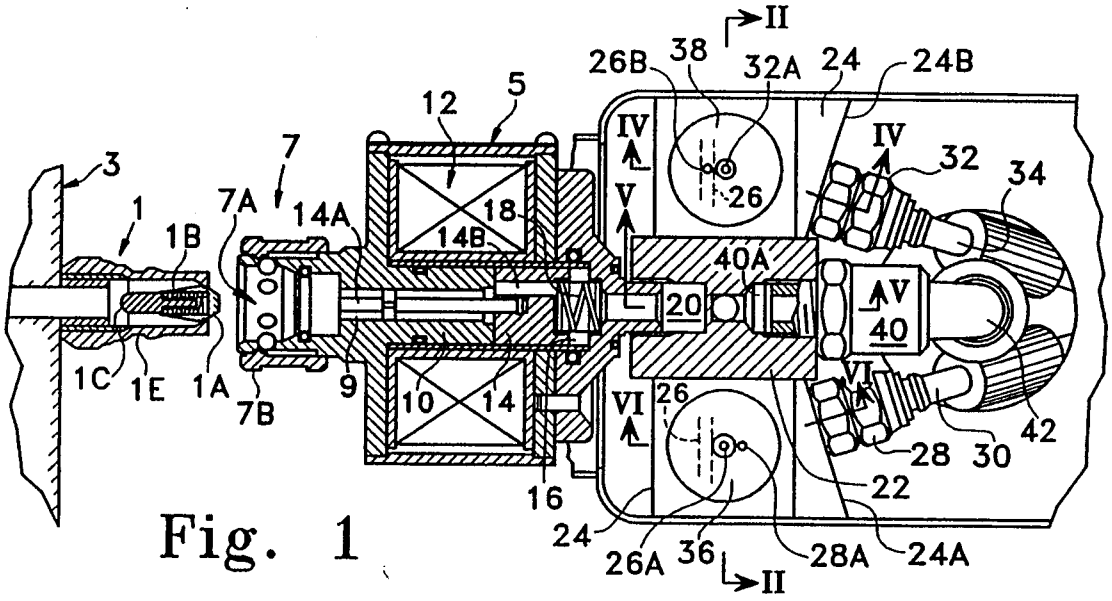
FIG. 1 shows a longitudinal section of the injector and of the connector for its coupling, which is separated when the injector is detached.
Figure 2:
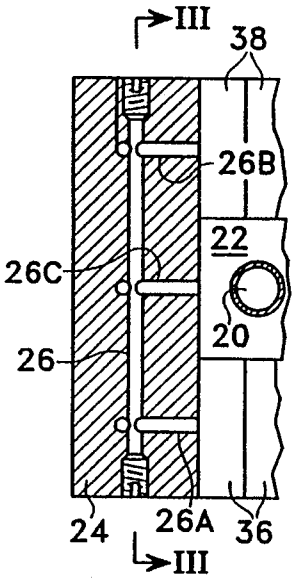
FIGS. 2, 3, 4, 5, and 6 show sections along II—II in FIG. 1, III—III in FIG. 2, and IV—IV, V—V, and VI—VI in FIG. 1.
Figure 3:
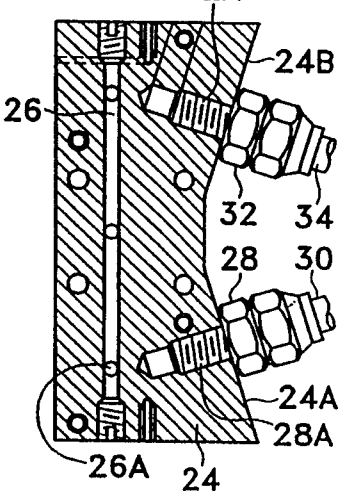
Figure 4:
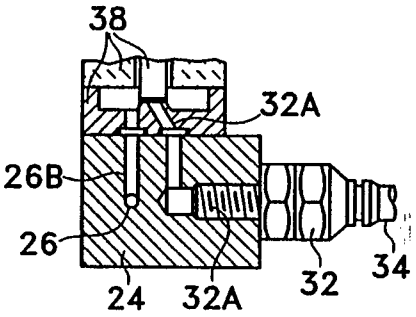
Figure 5:
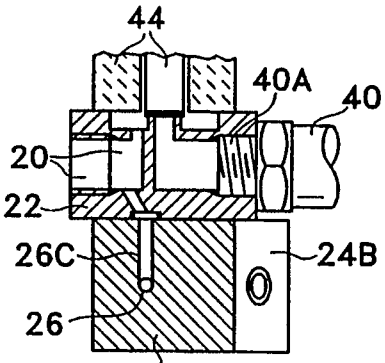
Figure 6:
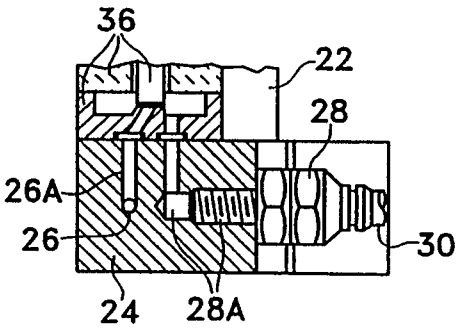
Figure 1A:
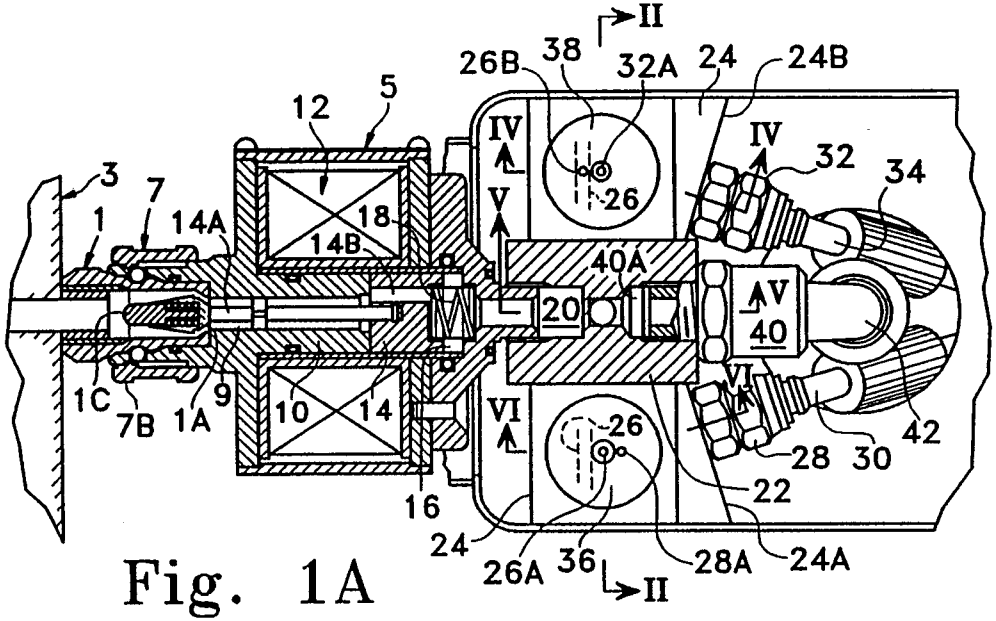
Figure 2A:
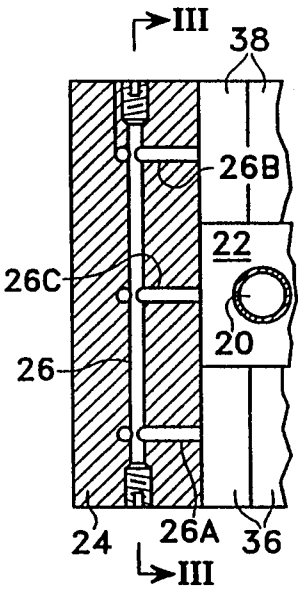
Figure 3A:
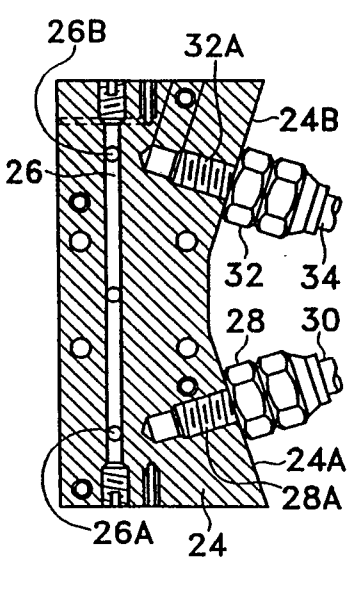
Figure 6A:
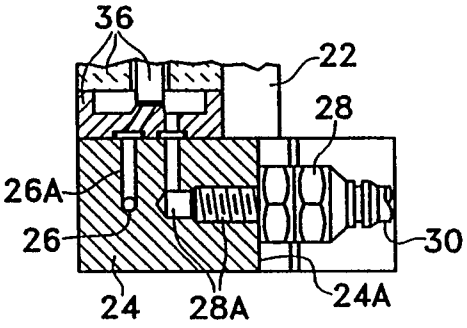
Figure 5A:
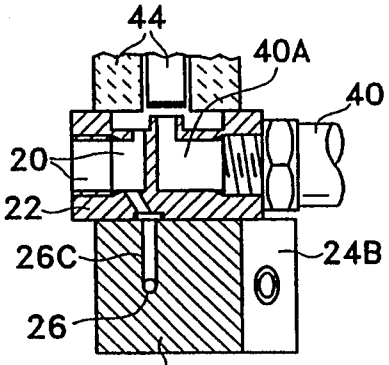
Figure 4A:
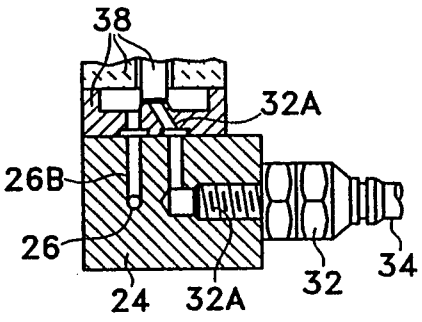
Figure 1B:
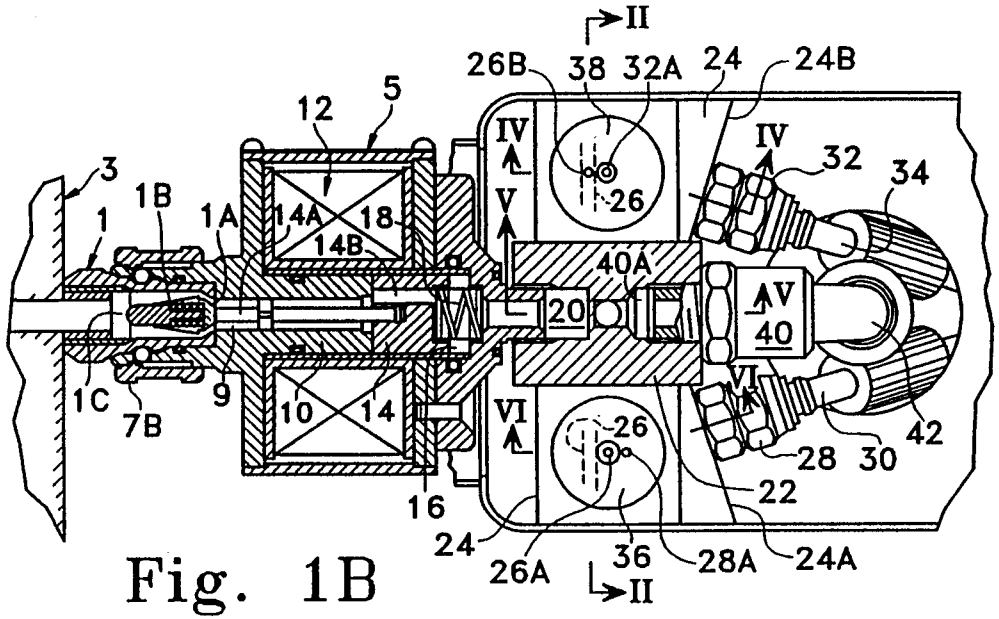
Figure 2B:
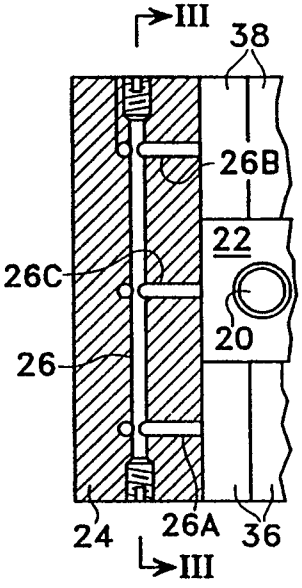
Figure 3B:
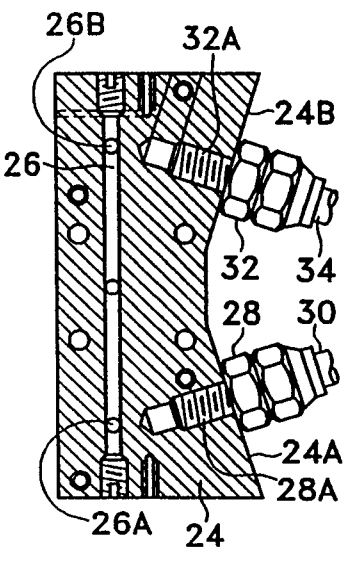
Figure 6B:
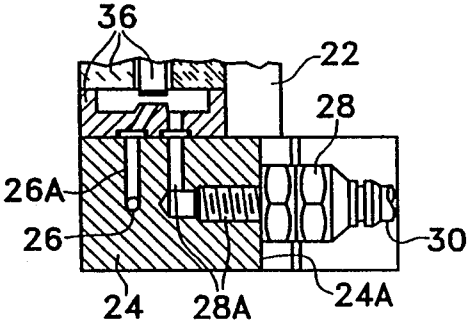
Figure 5B:
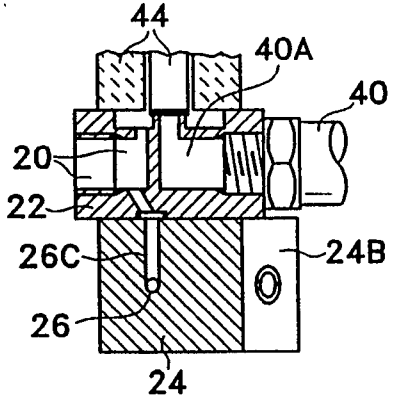
Figure 4B:
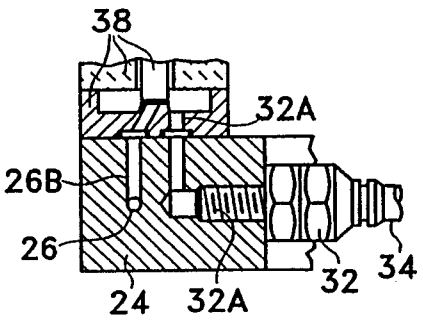

The cavity 7A is extended with an axial hole 9 formed in a body 10 developed axially and inside an electromagnet 12. The moving core or armature 14 of the electromagnet 12 may be displaced axially in a cavity in which is contained a small spring 18 which exerts an axial force which is much weaker than that provided by the spring 1B of the valve 1A of the part 1 of the quick-release coupling. The electromagnet 12 is capable of returning the moving core or armature 14 toward the left when the drawing is viewed, together with a rod 14A which is integral with said core 14 and capable of projecting into the cavity 7A and of acting on the coupling valve 1A, overcoming by the action of the electromagnet 12 the elastic force of the spring 1B which tends to close the valve 1A of the part 1 of the quick-release coupling, all this being done for the objects stated subsequently. passage 14B is formed in the core 14 and puts the cavity 7A together with the hole 9 into communication with the cavity 16 of the spring 18, the latter being in communication with a cavity 20 which is formed in a block 22. This block 22 is disposed centrally on a shaped transverse body 24 which has within it a transverse manifold 26 in the form of a through hole closed by end plugs for working requirements. The transverse body 24 has on an inclined surface 24A a connector 28 for a pipe 30 for a refrigerant fluid (such as the gas known as "freon") in the specific case of installations for the filling of a coolant system 3. On an inclined surface 24B opposite to and symmetrical with 24A there is provided a second connector 32 for a pipe 34 adjacent to a system for recovering the refrigrant fluid from the dead spaces of the injector to prevent it leaking into the atmosphere and also, where necessary, to allow the recovery of the refrigerant fluid or other equivalent from a system 3 which has to be evacuated for maintenance or destruction purposes, again using the quick-release attachment such as 1, 7. The connector 28 corresponds to a passage 28A formed in the transverse body 24 and extending to an electromagnetic valve 36 disposed on the transverse body 24 (see also FIG. 6), said valve 36 being capable of controlling the flow between the passage 28A and the connection 26A between the valve 36 and the manifold 26. The connector 32 is joined to a passage 32A (see also FIG. 4) equivalent to 28A which extends to a second electromagnetic valve 38 located on the transverse body 24 in a position symmetrical with respect to the electromagnetic valve 36 with respect to the central block 22; the electromagnetic valve 38 controls the flow between the passage 32A and a connection 26B between said electromagnetic valve 38 and the manifold 26. On the central block 22 there is fitted a connector 40 for a pipe 42 which leads to a vacuum pump discharging into the atmosphere since it is capable of removing non-pollutant gases or air from the confined volumes, as stated below. The connector 40 is Joined to a passage 40A (see also FIG. 5) formed in the central block 22 and extending to a central third electromagnetic valve 44 coupled to the block 22. This electromagnetic valve controls the flow between the passage 40A and the cavity 20 of the passage which extends to the cavity 16 and consequently the axial hole 9 and the cavity *7a*; a connection 26C is formed between the manifold 26 and the cavity 20 mentioned above. To sum up, the cavity 20 and consequently the cavities 16, 14B, 9 and 7A may be put into communication selectively, under the control of the electromagnetic valves 36, 38 and 44, with the pipes 30, 34 and 42 respectively for the objects stated below, or may be simultaneously isolated from all said pipes.

When the injector is detached, as shown in FIGS. 1 to 6, the three electramagnetic valves 36, 38 and 44 are closed and the dead space represented by the cavities 7A, 9, 14B, 16, and 20 is open to the atmosphere. When the injector 5 is coupled to a system 3, for example a new system or any system to be filled with a refrigerant fluid, the connection is made with the quick-release coupling 1, 7 and the electromagnet 12 is energized in such a way as to displace the core 14 with the rod 14A forward to cause the opening of the valve 1A, which has remained closed during the simple connection of the quick-release coupling 1, 7. By energizing the electromagnetic valve 44 at this point, the whole of the cavity of the system 3 and injector 7, which cavity consists of the various spaces 7A, 9, 14B, 16, 20 and 26, 26A, 26B, is put into communication with the vacuum pipe 42 (FIGS. 1A to 6A); in this way, the vacuum is established throughout these cavities, and this vacuum may be relatively very high. Immediately afterwards, the valve 44 is closed again and the valve 36 is opened, putting all the cavities under vacuum into communication with the pipe 30 (FIGS. 1B to 6B) to cause all said cavities to be filled with the refrigerant or coolant fluid such as the type known as "Freon" in the case of coolant installations, or in any case to fill all the cavities with the desired filling fluid which must not then leak, even in the form of pure and simple residues, into the atmosphere, given the pollution which this might cause. On completion of filling with the fluid from the pipe 30, the electromagnetic valve 36 is closed again and the electromagnet 12 is de-energized, so that the thrust of the spring 1B of the valve causes the core 14 and the rod 14A to be withdrawn against the action of the small spring 18, and the valve 1A closes, so that the space of the system 3 filled with the gas supplied by the pipe 30 is closed and isolated from the dead space formed in the injector 5 by the cavities 7A, 9, 14B, 16, 20, 26. Should the quick-release coupling 1, 7 be disconnected under these conditions, the residue of gas supplied by the pipe 30 and contained in said dead space may leak immediately or subsequently into the. atmosphere. To. avoid this, before the quick-release coupling 1, 7 is disconnected and therefore while the said dead space remains isolated from the atmosphere, the electromagnetic valve 38 is opened and the residue of gas is sucked from said dear space 7A, 9, 14B, 16, 20, 26 in such a way as to remove these residues which are conveyed to a suitable container connected to the pipe 34 so that they can be suitably destroyed or removed in the most appropriate way; this condition is illustrated in FIGS. 1C to 6C. When the electromagnetic valve 38 is closed again by de-energizing it, the injector 5 can be disconnected from the system 3 i.e. from the part 1 of the quick-release coupling 1, 7.

In certain cases, it is possible to cause an evacuation of the dead space of the injector after the quick-release coupling between 1 and 7 has been activated, and before opening the valve 1A; in this way a possible undesired transfer into the confined volume of the newly attached unit 3 is avoided.

It should be noted that the injector described above may also be used to evacuate a system 3 provided with the part 1 of the quick-release coupling 1,7, by removing its contents through the pipe 34 by opening the electromagnetic valve 38 under the conditions illustrated in FIGS. 1C to 6C, but simultaneously energizing the electromagnet 12, after the connection of the quick-release coupling between 1 and 7. Under these conditions, the evacuation which was described previously only for the dead space represented by the cavities 7A, 9, 14B, 16, 20, 26 is also performed through the open valve 1A for the space within the system 3, which may thus be evacuated for various reasons such as subsequent filling with fresh gas, a maintenance operation, or simply for the destruction of the system 3. Any subsequent filling will be carried out in the way described above.

Figure 7:
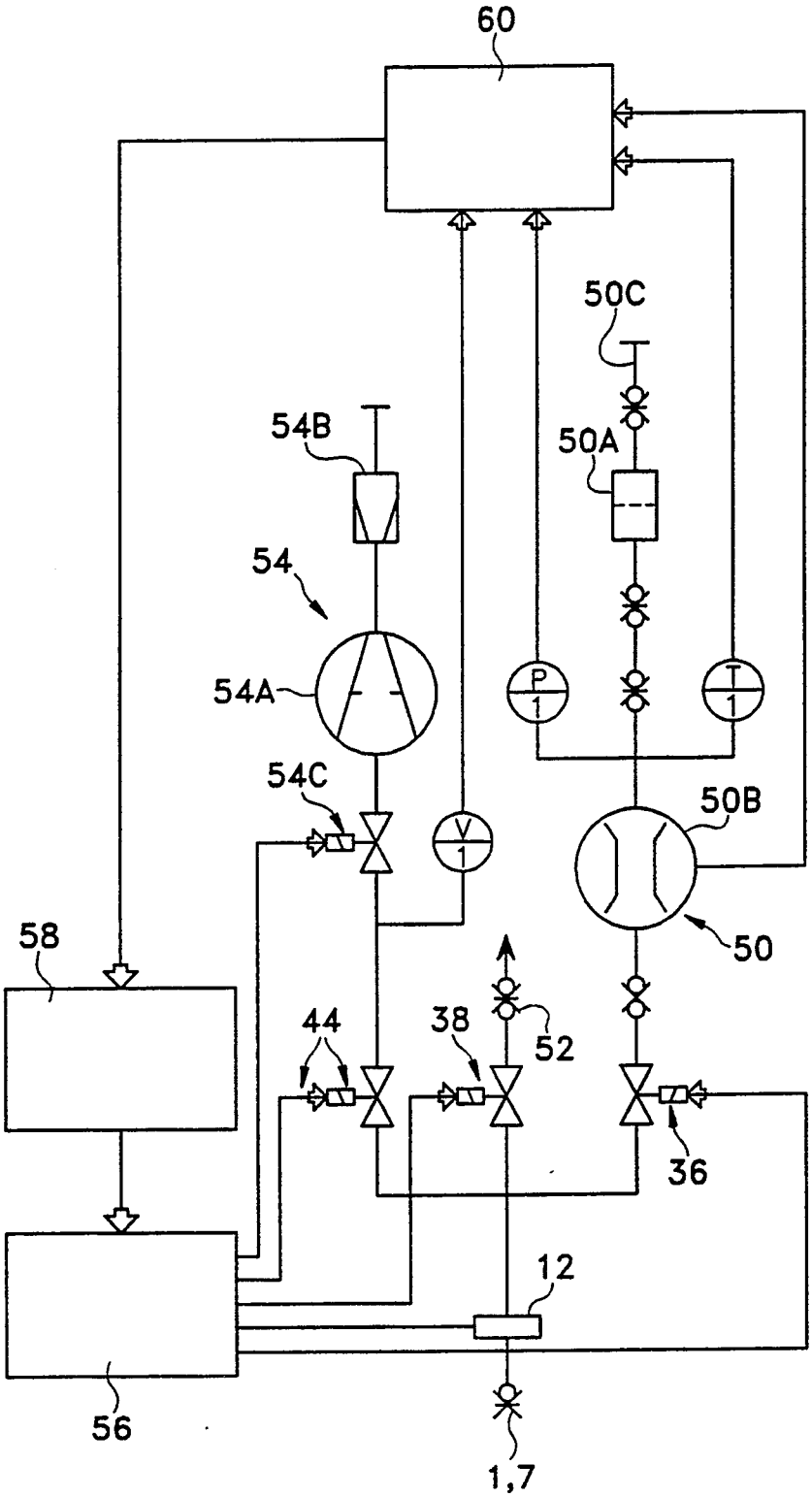
FIG. 7 is a schematic view of the system of the invention with a control unit for activating various operations.

The diagram in FIG. 7 illustrates a possible embodiment of a system with a control unit for activating the various operations with a manually operated initial or starter command. This diagram shows the quick-release attachment 1, 7, the electromagnet 12, and the electromagnetic valves 36, 38 and 44. The electromagnetic valve 36 is combined with a unit 50 with a filter 50A and a turbine 50B for the supply of the filling fluid, such as the refrigerant fluid, from a suitable source connected to the pipe 50C. The electromagnetic valve 38 is combined, via an optional quick-release coupling 52, with a system for recovering the fluid to be removed from the dead space or directly from the system such as the system 3 coupled for evacuation without pollution. The electromagnetic valve 44 is combined with a high-vacuum system 54 for creating the vacuum and for discharging air from the cavities which are isolated from the atmosphere and are to be filled with the refrigerant gas or the like; this system 54 comprises, among other components, a vacuum pump 54A and a discharging filter 54B for discharge into the atmosphere and other functions; in particular, an electromagnetic valve 54C may also be provided for an optional leakage testing facility. Also in the diagram in FIG. 7, the number 56 indicates overall an automated actuator designed to carry out a cycle by means of a manual starter or in another appropriate way; 58 indicates a control assembly which receives the signals and commands from a unit 60 which collects the signals from the various installations, particularly from the systems 50 and 54.

An injector such as that described may also be equipped with an additional system of electromagnetic valves and connections to an additional pipe for a flushing fluid, for example in order to remove moisture from the system 3 which is to be filled and to which the injector may be coupled, the flushing being performed with dry air, dry nitrogen or other substance. This arrangement may be provided in special bases of use of the injector, when particularly effective filling conditions are required with total exclusion of moisture and in any case absence of air in the filled system 3.

A control system of the fluid type, normally with pneumatic or hydraulic controls, may be provided in place of the electromagnetic type. These fluid control systems may partially or wholly replace the electrical control systems, which, however, appear to be more convenient.

It is to be understood that the drawing shows only one example provided solely as a practical demonstration of the invention, and that this invention may be modified in its forms and dispositions without thereby departing from the guiding principle of said invention. Any reference numbers in the attached claims have the purpose of facilitating the reading of the claims with reference to the description and the drawing and do not in any way restrict the scope of protection represented by the claims.

I claim:

1. An injector for filling confined spaces of systems, comprising:

a connector communicating with a confined volume having the confined space;

a connector valve regulating fluid flow through said connector;

a quick-release coupling, said quick release coupling positioned between said control unit and said connector for connection to said connector;

a passage leading from said quick-release coupling;

control unit means for opening said connector valve independently of the connection status of said quick release coupling a manifold connected to said passage;

a fluid supply pipe connected to said manifold;

a vacuum source pipe connected to said manifold;

a suction recovery pipe connected to said manifold;

a fluid supply connection connected to an end of said fluid supply pipe, opposite said manifold;

a vacuum source connection connected to said vacuum source pipe at an end of said vacuum source pipe opposite said manifold;

a suction recovery connection connected to said suction recovery pipe at an end of said suction recovery pipe opposite said manifold;

a fluid supply valve connected to said fluid supply connection;

a vacuum source valve connected to said vacuum source connection; and a suction recovery valve connected to said suction recovery connection, said fluid supply valve, said vacuum source valve said suction recovery valve and said connector valve cooperating to delimit a dead space and thereby defining means to allow discharge, extraction, or recovery of a pollutant fluid from said dead space independent from discharge, extraction or recovery of pollutant fluid from the confined volume of said system.

2. An injector according to claim 1, wherein:

said quick-release coupling includes a terminal part, said control unit being coaxial with said terminal part and having an electromagnet actuator.

3. An injector according to claim 1, further comprising:

an electromagnetic control connected to each of said fluid supply valve, said vacuum source valve and said suction recovery valve for controlling opening and closing thereof.

4. An injector according to claim 1, wherein:

said control unit is connected to a pneumatic servo control system.

5. An injector according to claim 1, further comprising:

an additional pipe connected to said manifold with a corresponding control valve end connection for supplying a flushing fluid.

6. An injector according to claim 1, further comprising;

a control assembly connected to said control unit for controlling said control unit.

7. An injector confined spaces of systems, comprising:

a connector communicating with a confined volume having the confined space;

a connector valve blocking said connector;

a quick-release coupling, said quick release coupling positioned between said control unit and said connector;

a control means for opening said connector valve independently of said quick release coupling, said quick release coupling being positioned between said control unit and said connector;

a passage leading from said quick-release coupling;

a manifold connected to said passage;

a fluid supply pipe connected to said manifold;

a vacuum source pipe connected to said manifold;

a suction recovery pipe connected to said manifold;

a fluid connection connected to an end of said fluid supply pipe, opposite said manifold;

a vacuum source connection to said vacuum source pipe at an end of said vacuum source pipe opposite said manifold;

a suction recovery connection connected to said suction recovery pipe at an end of said suction recovery pipe opposite said manifold;

a fluid supply valve connected to said fluid supply connection;

a vacuum source valve connected to said vacuum source connection; and a suction recovery valve connected to said suction recovery connection, said fluid supply valve, said vacuum valve, said suction recovery valve and said connector valve cooperating to delimit a dead space and thereby defining means to allow discharge, extraction, or recovery of a pollutant fluid from said dead space independent from discharge, extraction or recovery of pollutant fluid from the confined volume of said system;

an electromagnetic control connected to each of said fluid supply valve, said vacuum source valve and said suction recovery valve for controlling opening and closing thereof.

8. An injector according to claim 7, further comprising:

a control assembly connected to each of said control unit, said fluid supply electromagnet, said vacuum source electromagnet and said suction recovery electromagnet for opening and closing selected ones of said connector valve, said fluid supply valve, said vacuum source valve and said suction recovery valve for controlling various phases of discharge, extraction or recovery of pollutant fluid from said dead space and said confined volume of said system.

* * * * *